US007140054B2

(12) United States Patent
Charles

(10) Patent No.: US 7,140,054 B2
(45) Date of Patent: Nov. 28, 2006

(54) MOVABLE PATIENT BATHING APPARATUS

(75) Inventor: Leonel E. Charles, St. Petersburg, FL (US)

(73) Assignee: Marlene C. Berthelot, St. Petersburg, FL (US)

( * ) Notice: Subject to any disclaimer, the term of this patent is extended or adjusted under 35 U.S.C. 154(b) by 143 days.

(21) Appl. No.: 11/062,530

(22) Filed: Feb. 22, 2005

(65) Prior Publication Data

US 2006/0185088 A1 Aug. 24, 2006

(51) Int. Cl.
*A47K 3/12* (2006.01)

(52) U.S. Cl. ..... 5/606; 5/429; 5/928; 5/900; 4/585; 4/589

(58) Field of Classification Search ..... 5/933, 5/428, 429, 606, 928, 900, 611; 4/585, 589, 4/547, 597, 560.1, 562.1
See application file for complete search history.

(56) References Cited

U.S. PATENT DOCUMENTS 3,742,527 A * 7/1973 Johnston et al. ..... 5/611
3,800,336 A 4/1974 Hoxeng
4,002,330 A * 1/1977 Johansson ..... 5/606
4,055,863 A 11/1977 Duval
4,142,259 A * 3/1979 Moore ..... 4/661
4,305,165 A 12/1981 Wall, Jr.
4,713,850 A * 12/1987 Flaherty et al. ..... 4/585
4,821,348 A 4/1989 Pauna
5,285,539 A 2/1994 Anderson et al.
5,704,083 A * 1/1998 Nerg ..... 5/600
5,839,135 A 11/1998 Kitamura
5,898,959 A 5/1999 Ricker
5,909,970 A 6/1999 Velazquez
6,418,573 B1 7/2002 Masuda
6,421,853 B1 7/2002 Pecorelli et al.
6,802,088 B1 10/2004 Gruner
6,871,367 B1 * 3/2005 Beckles et al. ..... 5/606
2001/0025389 A1 10/2001 Kitamura

* cited by examiner

*Primary Examiner*—Michael Trettel
(74) *Attorney, Agent, or Firm*—Larson & Larson; Herbert W. Larson

(57) ABSTRACT

A rectangular structure on wheels has a first and second slab. The first slab supports the patient's washing apparatus including heated water tank, an air blower and waste water tank. The second or top slab spaced apart above the first slab has an attached hinged back rest and is covered with a message pad and a disposable washing liner. The top slab is configured to have waste water flow into a drain which leads to the waste water tank.

16 Claims, 8 Drawing Sheets

MOVABLE PATIENT BATHING APPARATUS

BACKGROUND OF THE INVENTION

1. Field of the Invention

The present invention relates to a patient bathing apparatus. More particularly, it refers to a movable self contained apparatus for bathing immobilized patients.

2. Description of the Prior Art

Immobile patients in hospitals and nursing homes need to be bathed at regular intervals. An apparatus for bathing such patients is described in U.S. Pat. No. 4,055,863. Although this apparatus is useful for its intended purposes, the employment of a water-tight chamber prevents nursing care personnel from attending to the patient. A patient bathing apparatus is needed which allows care personnel to directly assist in the bathing process.

SUMMARY OF THE INVENTION

The present invention improves the prior art apparatus for bathing immobile patients. The present apparatus is a rectangular structure on wheels. A back panel is lifted to a sixty degree angle inclination by two hydraulic lifters. Feeder hoses provide heated water from a water heater and hot air from an air blower source. Waste water exits via openings in the bottom of a holding tank. A ten horse power engine powers the device including providing vibration via pads at the bottom of a support slab. A combined scrubbing brush and dryer is attached to an end of the feeder hose. The wheels are connected to struts that raise or lower the tank. The bottom of the top slab is angled so waste water flows to openings in the bottom of the top slab. A disposable washing liner is draped over a top surface of the apparatus and water employed over the patient flows down an attached drain to the waste water holding tank mounted on a lower slab. Stanchions at the four corners of the apparatus support the bottom slab containing cleaning apparatus and a top slab spaced apart above the bottom slab. The top slab supports the patient on a soft pad.

BRIEF DESCRIPTION OF THE DRAWINGS

This invention can be best understood by those having ordinary skill in the art by reference to the following detailed description, when considered in conjunction with the accompanying drawings in which.

DETAILED DESCRIPTION OF THE INVENTION

Figure 1:
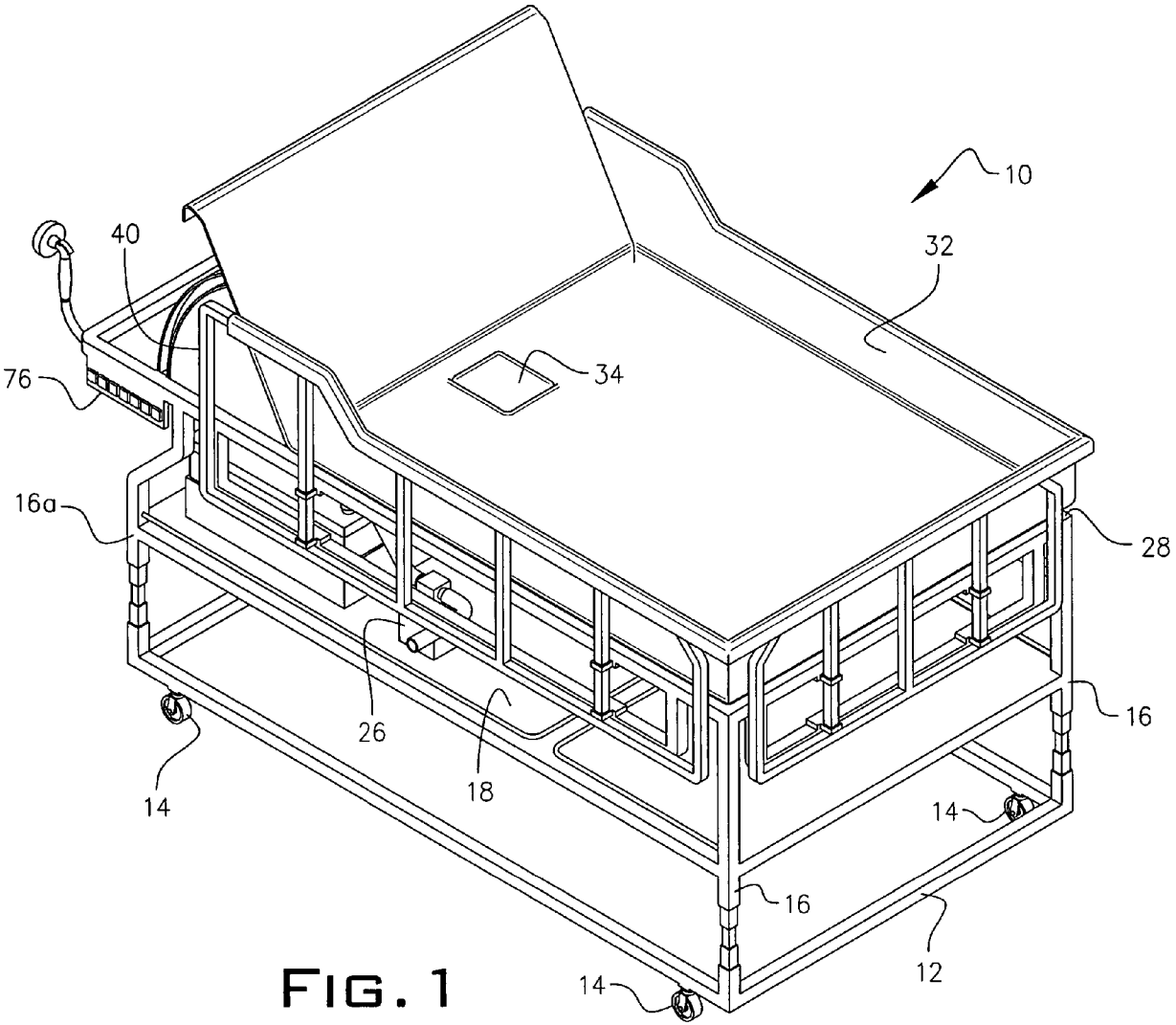
FIG. 1 is an isometric view of the apparatus of this invention covered with a disposable washing liner.
Figure 2:
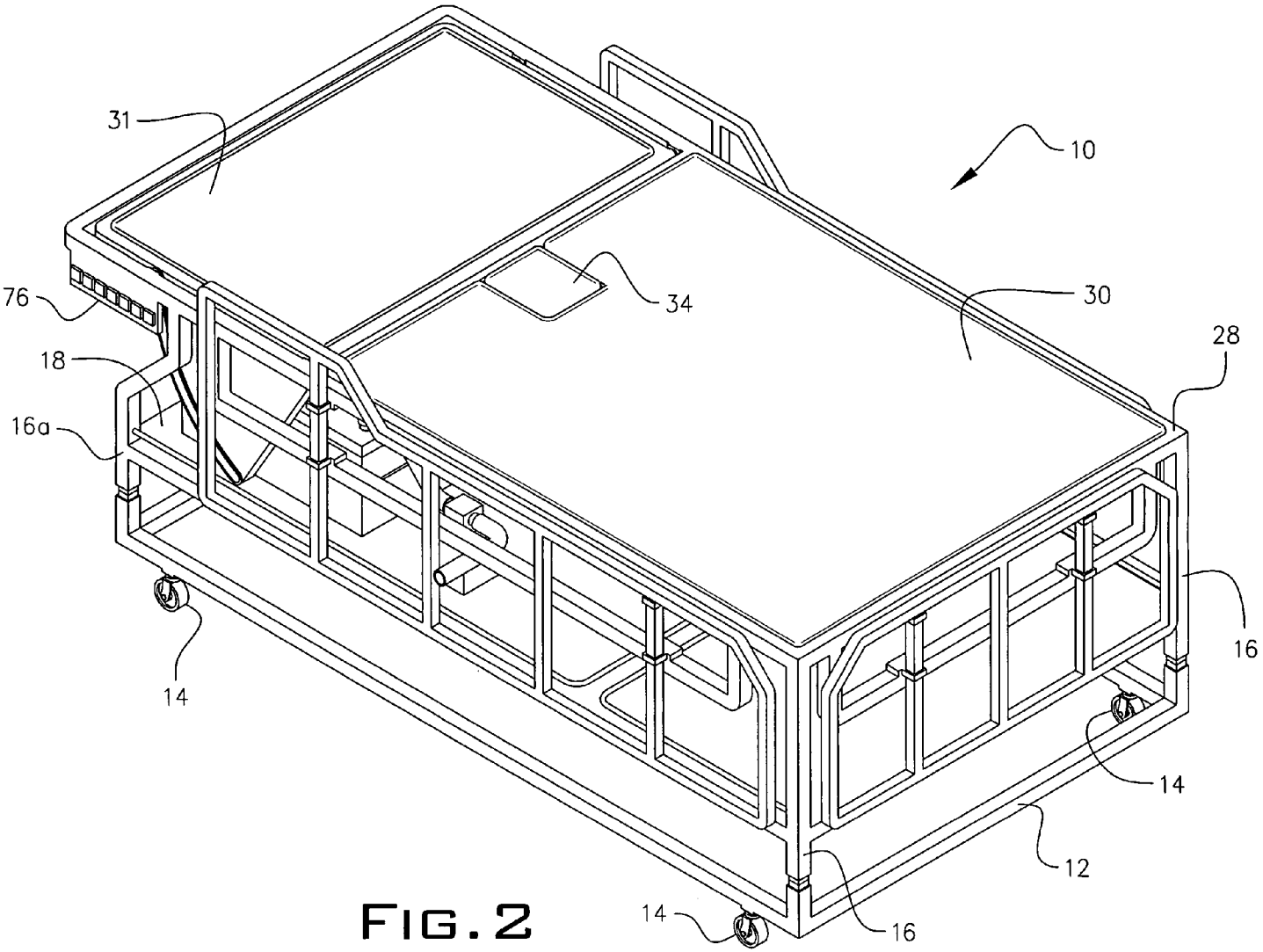
FIG. 2 is an isometric view of the apparatus without the washing liners and the back rest lowered.

Throughout the following detailed description the same reference numerals refer to the same elements in all figures.

The movable patient bathing apparatus 10 has a rectangular tubular frame 12 supported by rollers 14 under each corner area. Stanchions 16 or 16*a* are welded to the tubular frame 12 at each corner. A first rectangular slab 18 is spaced apart above tubular frame 12 and is attached at all four corners to one of the stanchions 16 or 16*a*. The first slab 18 supports a water tank 20, a heating element 21, a heated fresh water tank 22, an air pump 24, a water pump 26 and a hydraulic pump 66. Hydraulic fluid lines 68 are used to raise or lower the stanchions 16 and 16*a*. Hydraulic fluid line 70 is used to raise or lower head support 31.

Figure 3:
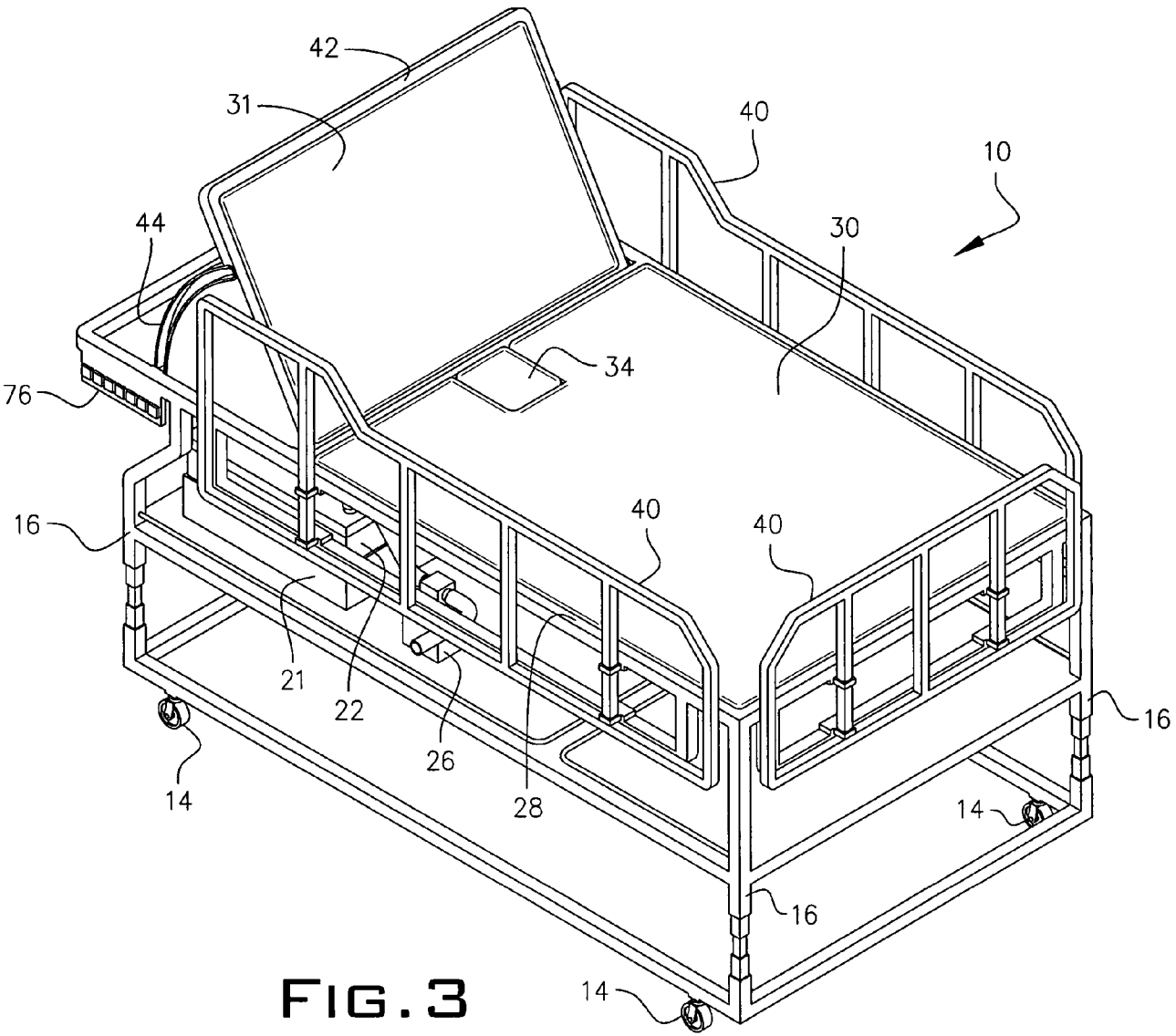
FIG. 3 is an isometric view of the apparatus without the washing liner, and the foot and side rails raised.
Figure 4:
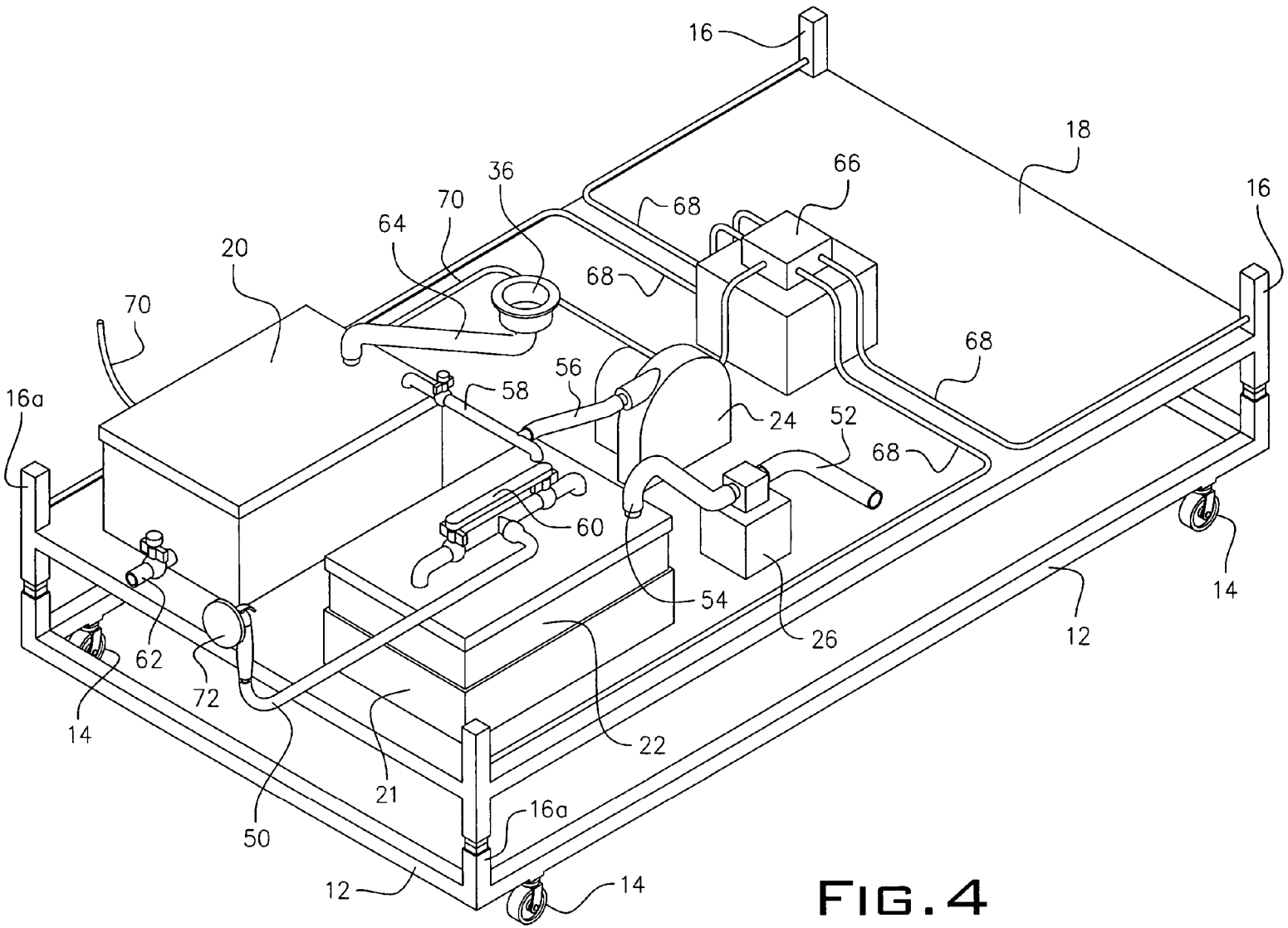
FIG. 4 is an isometric view of the fixtures mounted on the lower slab of the apparatus.
Figure 5:
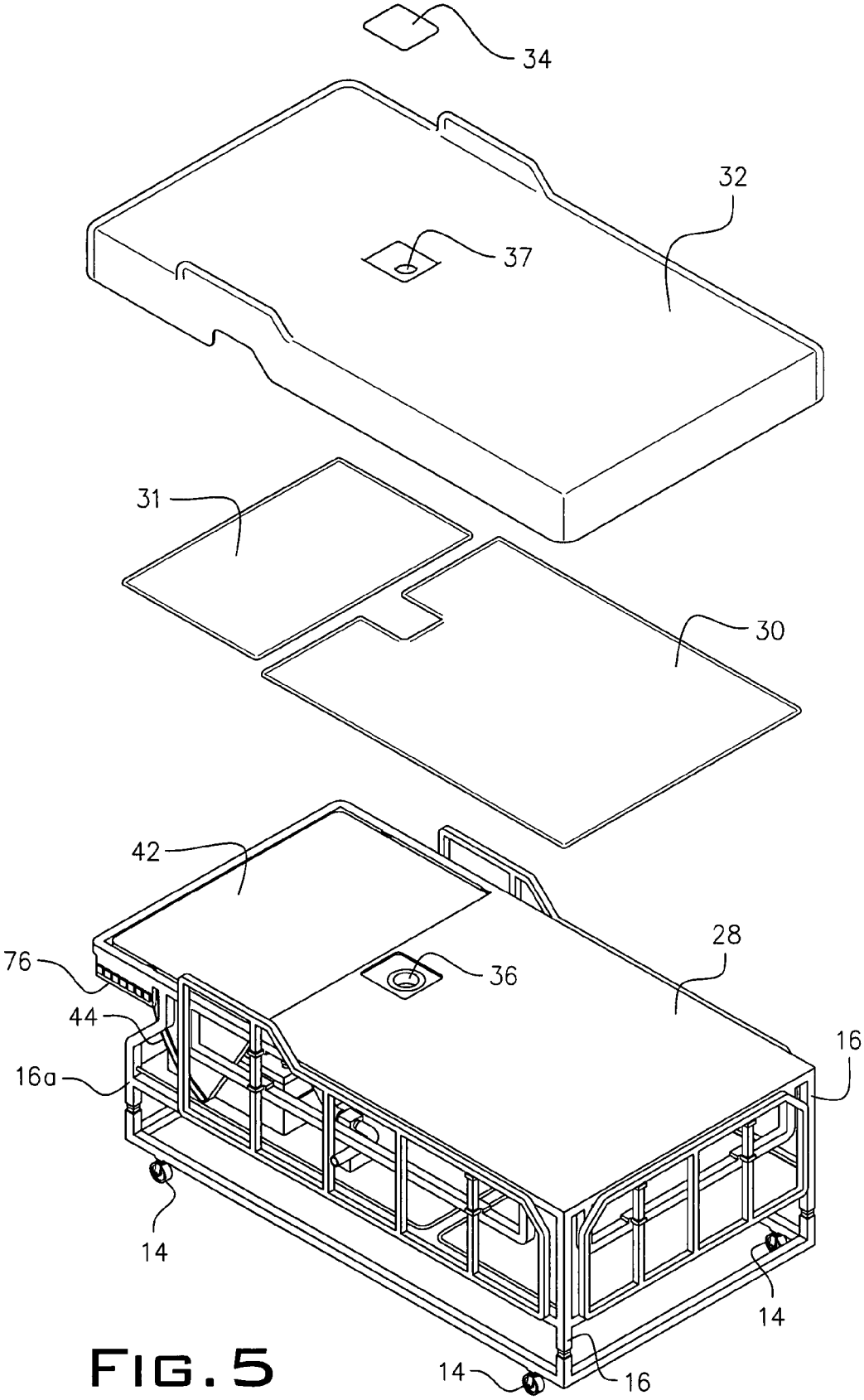
FIG. 5 is an exploded view of the apparatus showing the top slab, patient pad and disposable washing liner.
Figure 6:
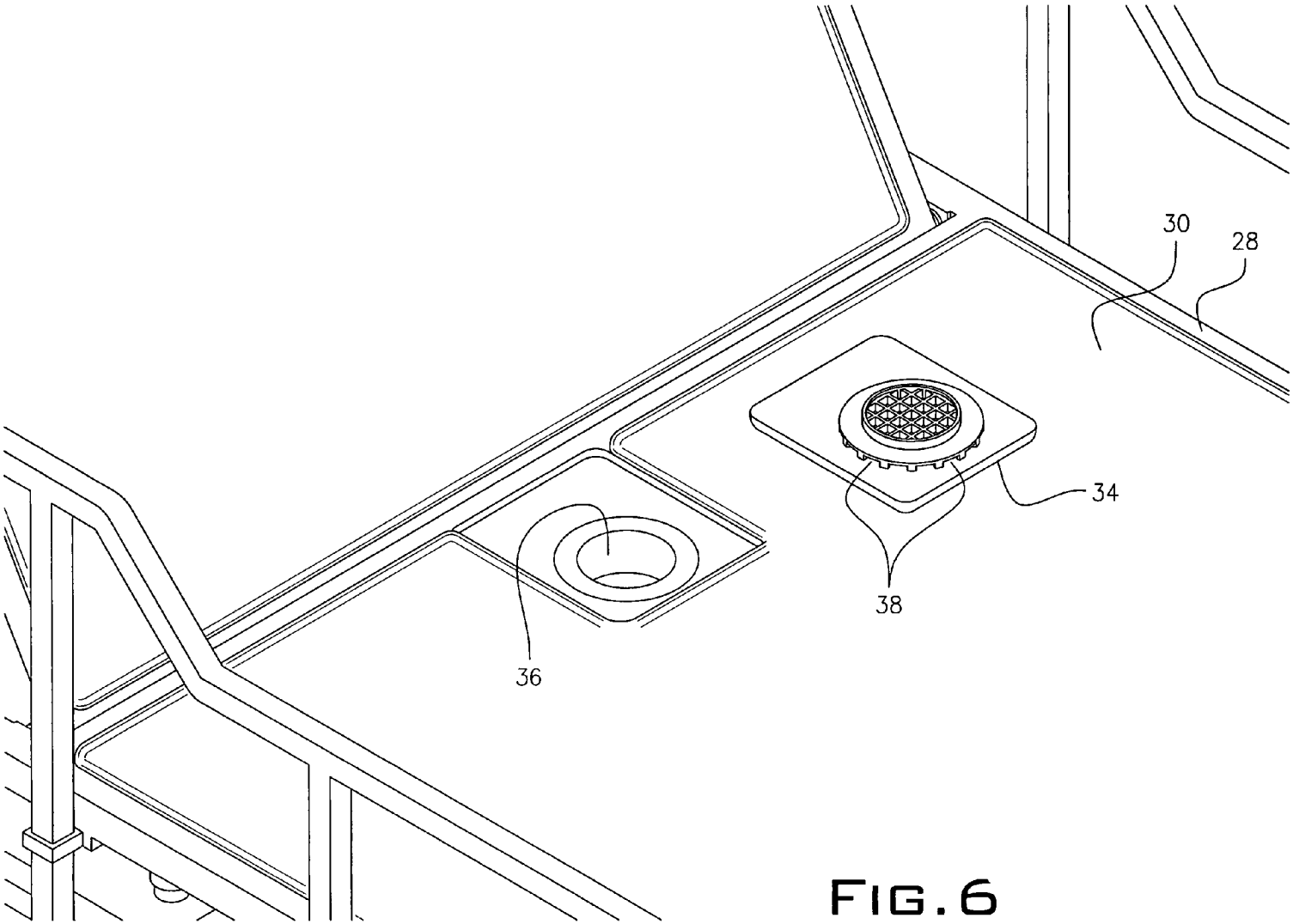
FIG. 6 is a view of the bed drain and an upside down view of the bed drain plug.

Spaced apart above first slab 18 is a second rectangular slab 28 attached to the top of each stanchion at each corner of the second slab. A massage pad 30 covers the second rectangular slab 28. During washing of the patient, a disposable washing liner 32 covers the pad 30 and is draped around the top portion of rails 40 as seen in FIG. 1. A drain plug 34 covers openings 36 and 37 for disposal of waste water in the washing cycle. The plug 34, as seen in FIG. 6 has side openings 38 for a water passageway into the drain opening 36. Conduit 64 directs the waste water to waste water tank 20. As seen in FIGS. 1 and 3 side rails 40 are raised as a safety measure to prevent the patient from rolling off the massage pad.

Figure 7:
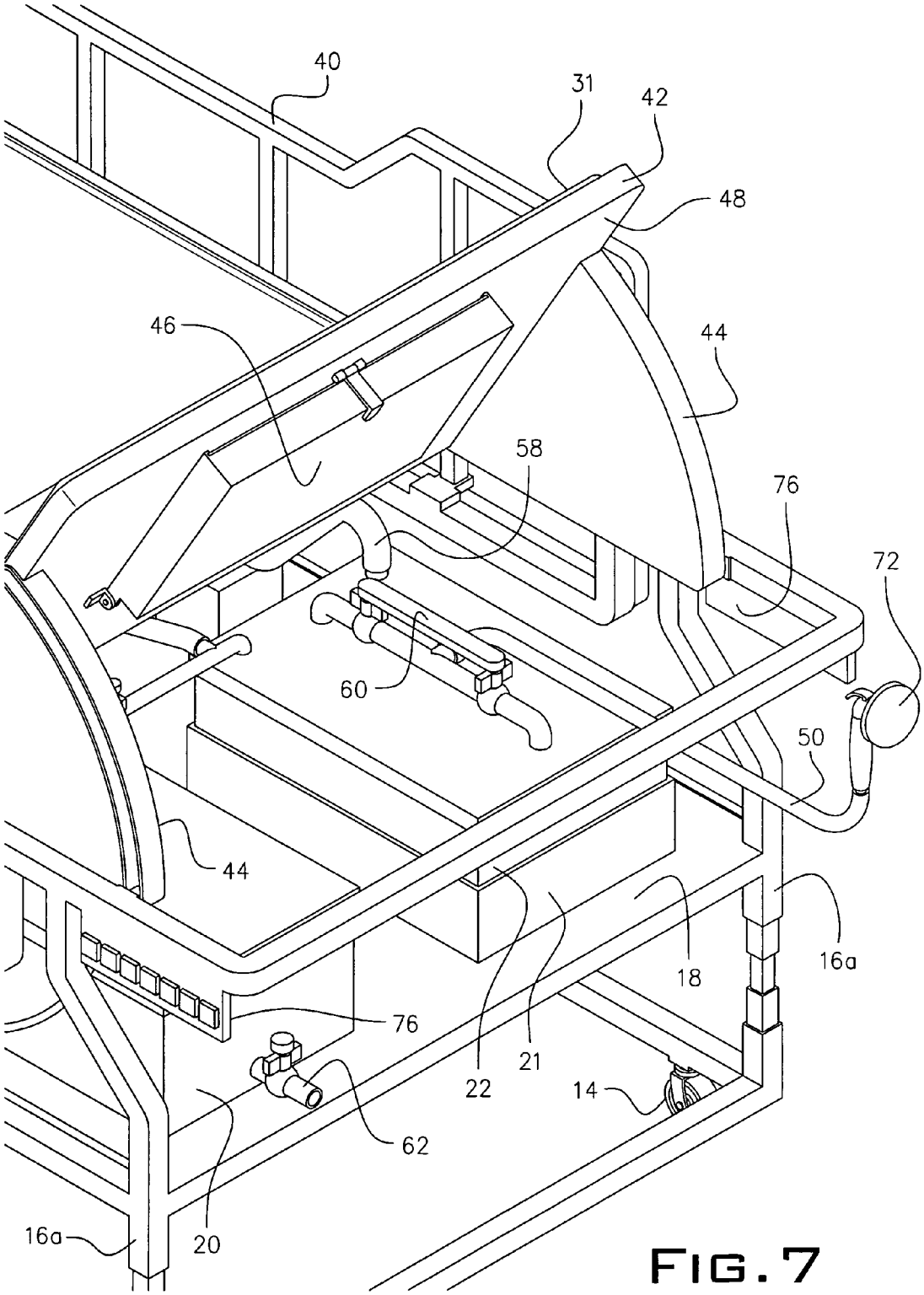
FIG. 7 is a rear view of the back rest of the apparatus shown in FIG. 3.
Figure 8:
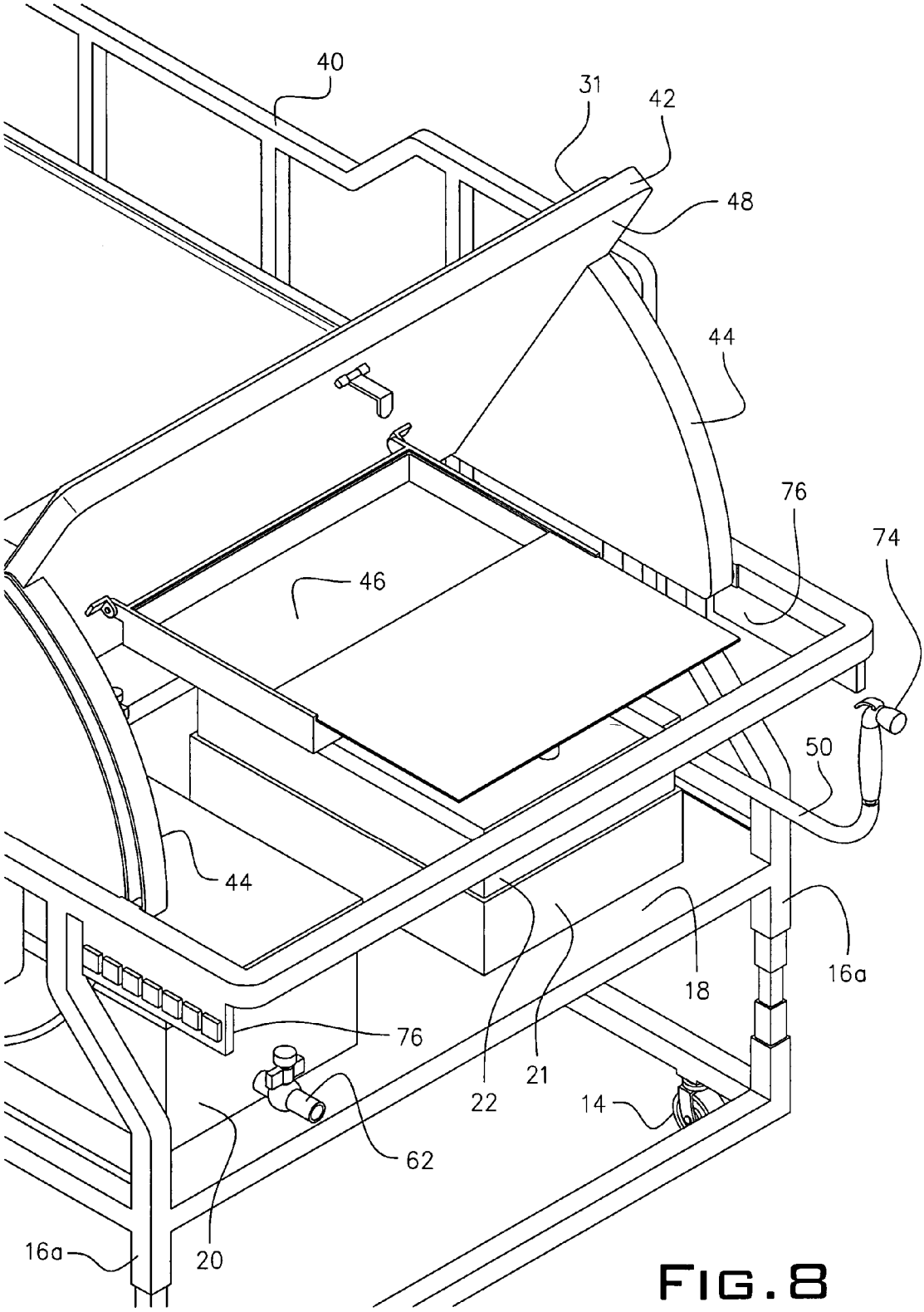
FIG. 8 is the same view as seen in FIG. 7 with the accessory storage case open.

A back support 42 is hinged to a top portion of slab 28 and is raised or lowered by a hydraulic system 44 and hydraulic conduits 70 leading from hydraulic pump 66. A pad 31 covers the back support 42. As seen in FIGS. 7–8, a storage case 46 is attached to a bottom surface 48 of back support 42. In operation, heated water from tank 22 passes through hose 50 to a scrubber 72 or spray device 74 for spraying on the patient lying on the disposable liner 32. The tank 22 is replenished with water from an external water source through conduit 52. The external water passes through water pump 26 and enters the fresh water tank 22 at inlet 54. An air pump 24 passes air through tube 56 to a connecting tube 58 leading in one direction to the waste water tank 20 and in the other direction to an air to water switch 60 which pressurizes the water coming out of hose 50. When the patient has been cleaned switch 60 activates the air from pump 24 to dry the patient. A drain 62 in the waste water tank 20 permits drainage after each use. The bed drain 36 conducts water through hose 64 to the waste water tank 20.

The operation of the apparatus, i.e. raising and lowering the frame and operating the hydraulic system, is controlled from panel 76.

Equivalent elements can be substituted for the elements of this apparatus to provide substantially the same function, in substantially the same way to produce substantially the same results.

Having thus described the invention, what is claimed for Letters Patent follows:

1. A movable patient bathing apparatus comprising:

a rectangular base frame having four corners supported by multiple rollers;

an upright stanchion at each corner supporting a first planar rectangular slab supporting a waste water tank, a water pump, an air pump and a heated fresh water tank;

the upright stanchion at each corner further supporting a second planar rectangular slab spaced apart and above the first planar rectangular slab, a movable safety rail attached on a left, a right, and a foot portion of the bathing apparatus;

a hinged back support hydraulically raised and lowered attached to a top edge of the second slab; and a drain plug for a passageway passing through a massage pad and the second planar rectangular slab to the waste water tank.

2. The movable patient bathing apparatus according to claim 1, wherein a tube passes pressurized air from the air pump to the waste water tank and an air to water switch controlling the flow of air into the fresh water tank.

3. The movable patient bathing apparatus according to claim 1, wherein the apparatus can be raised or lowered by an hydraulic pump and hydraulic conduits leading to each stanchion.

4. The movable patient bathing apparatus according to claim 1, wherein the drain plug has lateral openings for passage of water.

5. The movable patient bathing apparatus according to claim 1, wherein an electric heating element is within the fresh water tank.

6. The movable patient bathing apparatus according to claim 1, wherein the hinged back support has a massage pad over a top surface and a disposable washing liner covers the massage pads on the back support and a massage pad on the second planar rectangular slab.

7. The movable patient bathing apparatus according to claim 1, wherein the hinged back support has an accessory storage case attached to a bottom surface.

8. The movable patient bathing apparatus according to claim 1, wherein the first planar slab further supports a hydraulic pump.

9. The movable patient bathing apparatus according to claim 8, wherein the hydraulic pump controls a raising and lowering of the bathing apparatus and a raising and lowering of the hinged back support.

10. The movable patient bathing apparatus according to claim 1, wherein an air to water switch mounted on the fresh water tank provides activation of air and water to a hose used in washing the patient.

11. A rectangular patient bathing apparatus comprising:

a base frame supported by a roller at each one of four corners;

an upright post at each corner of the base frame attached to corresponding corners of a first planar support surface, the support surface having mounted thereon a waste water tank, a water pump, an air pump and a heated fresh water tank;

a second planar support surface attached at corresponding corners to the upright posts, spaced apart and above the first planar support surface, the second planar support surface covered by a massage pad;

a safety rail movable in a vertical direction attached to a left and right side and foot portion of the bathing apparatus;

a hinged back support covered by a massage pad, the support hydraulically raised and lowered attached to a top edge of the second support surface;

a disposable washing liner draped over a top portion of the safety rails and covering the massage pad on the back support and the second planar support surface; and a drain plug for a passageway passing through the massage pad and the second planar support surface to the waste water tank.

12. The rectangular patient bathing apparatus according to claim 11, wherein the drain plug has lateral opening for passage of water.

13. The rectangular patient bathing apparatus according to claim 11, wherein the back support has an accessory storage case attached to a bottom surface.

14. The rectangular patient bathing apparatus according to claim 11, wherein the apparatus can be raised or lowered by an hydraulic system mounted on the first planar support surface.

15. The rectangular patient bathing apparatus according to claim 11, wherein an air to water switch mounted on the heated fresh water tank controls the ingress of water and air to a conduit leading to a patient spray head.

16. Method for bathing an immobilized patient comprising:

providing an apparatus having a rectangular base frame having four corners supported by multiple rollers;

providing an upright stanchion at each corner supporting a first planar rectangular slab supporting a waster water tank, a water pump, an air pump and a heated fresh water tank and a hydraulic pump;

providing a second planar rectangular slab attached at each corner to the upright stanchions, the second rectangular slab spaced apart above the first rectangular slab;

providing a hinged back support hydraulically raised and lowered by the hydraulic pump, the back support attached to a top edge of the second slab;

providing a massage pad over the hinged back support and the second slab;

providing a disposable washing liner over the massage pad, the liner draped over a top portion of a side rail;

providing a drain plug covering a passageway from the disposable washing liner to the waste water tank;

transferring the immobilized patient from a patient bed to the second planar slab covered with the massage pad and disposable washing liner; and washing the patient and drying the patient from water and air respectively coming from the water pump and air pump mounted on the first slab.

* * * * *